United States Patent [19]

Kunz et al.

[11] 4,329,567

[45] May 11, 1982

[54] ELECTRICALLY HEATED ROTATABLE CURLER BRUSH

[75] Inventors: Raymond W. Kunz, Monroe; Eugene T. Fleischhauer, Stamford, both of Conn.

[73] Assignee: Clairol Incorporated, New York, N.Y.

[21] Appl. No.: 70,071

[22] Filed: Aug. 27, 1979

[51] Int. Cl.[3] ..... H05B 3/40; A45D 2/36; A46B 7/10

[52] U.S. Cl. ..... 219/222; 15/27; 132/11 R; 132/33 R; 132/34 R; 132/85; 132/118; 219/244

[58] Field of Search ..... 219/222–226, 219/373, 533, 244; 132/34 R, 7, 9, 11 R, 33 R, 85, 118, 117; 15/159 R, 27

[56] References Cited

U.S. PATENT DOCUMENTS

| | | | |
|---|---|---|---|
| 372,092 | 10/1887 | Stansbury | 132/34 |
| 2,545,885 | 3/1951 | Jackson | 132/118 |
| 3,533,421 | 10/1970 | Mays | 132/34 X |
| 3,578,947 | 5/1971 | McNair | 219/226 |
| 3,947,910 | 4/1976 | Akerman | 132/34 X |
| 4,023,578 | 5/1977 | Buhler | 132/9 |
| 4,024,375 | 5/1977 | Olesen et al. | 219/225 |
| 4,029,110 | 6/1977 | Hyland | 132/9 |
| 4,097,718 | 6/1978 | Weise | 219/222 |
| 4,197,608 | 4/1980 | Holley et al. | 132/118 X |

FOREIGN PATENT DOCUMENTS

| | | | |
|---|---|---|---|
| 867075 | 9/1978 | Belgium | 219/222 |

*Primary Examiner*—A. Bartis

*Attorney, Agent, or Firm*—George A. Mentis

[57] ABSTRACT

A lockable rotatable heated curling brush which is used for styling and curling hair includes a rod housing which serves as a handle, an inner tube fixedly connected to said handle and protruding therefrom, a heater inside said inner tube electrically connected to a swivel cord, and an outer tube rotatably supported by said inner tube, said outer tube having a round brush on the outer surface thereof. The outer tube is held in the handle by a circular guide in front which mates with a notched flange at the rear of the outer tube. There is a spring latch device which locks or frees the outer tube so it can rotate. The inner tube within the outer tube is aluminum and is in heat conducting relationship with the heater and the outer tube. The heater is positioned in the inner tube such that the axial center of the heater is forward of the longitudinal center of the inner tube at a point which offsets the unequal heat loss rate to the atmosphere of the forward and rearward ends of the outer tube whereby maximum uniform heating of the outer tube and brush occurs. The preferred heater is a positive temperature coefficient (PTC) thermistor.

2 Claims, 4 Drawing Figures

ELECTRICALLY HEATED ROTATABLE CURLER BRUSH

BACKGROUND OF THE INVENTION (a) Field of the Invention

The present invention relates to a lockable rotatable heated curling brush which is used for styling and curling hair. More particularly, this invention relates to a rotatable heated curling brush having a rod housing which serves as a handle, an inner tube fixedly connected to said handle and protruding therefrom, a heater inside said inner tube electrically connected to a swivel cord, and an outer tube rotatably supported by said inner tube, said outer tube having a round brush on the outer surface thereof.

(b) Description of the Prior Art

Known curlers with lockable rotatable heated brushes having heating units in the inner tube are characterized as having the inner tube and outer tube made from heat conductive material such as fiberglass filled polyamide. The inner and outer tubes are made of the same material and thus have the same coefficient of expansion, thus assuring that the rotatability of the brush is not adversely affected. We have found, however, that the distribution of heat in such curler brushes is uneven, being hotter in the center and cooler on the ends, thus adversely affecting the performance of the curler. There is a need, therefore, to improve the heat distribution on the curling brush.

SUMMARY OF THE INVENTION

Accordingly, it is an object of this invention to provide an improved heated lockable, rotatable curler brush having means to provide uniform heat distribution in the curler brush.

The present invention provides a lockable rotatable heated curling brush having a rod housing which serves as a handle, an inner tube fixedly connected to said handle and protruding therefrom, a heater inside said inner tube electrically connected to a swivel cord, and an outer tube rotatably supported by said inner tube, said outer tube having a round brush on the outer surface thereof. The inner tube is fixed to the handle by a through bolt near its rearmost end. The outer tube is held in the handle by a circular guide in the front end of the handle which mates with a notched flange at the rear of the outer tube. This flange has notches which is conjunction with a spring latch device, attached pivotally to the inner tube, holds the round brush fast or releases it to freely rotate. The outer tube is supported by the inner tube and held captive by an inward facing groove on the front edge of the handle which mates with the notched flange. The front end of the outer tube is supported by the front end of the inner tube. The inner tube within the outer tube is aluminum and is in heat conducting relationship with the heater and the outer tube. The heater is placed in the inner tube such that the axial center of the heater is positioned forward of the longitudinal center of the inner tube at a point which offsets the unequal heat loss rate to the atmosphere of the forward and rearward ends of the outer tube whereby a maximum uniform heating of the outer tube and brush occurs. The preferred heater is a positive temperature coefficient (PTC) thermistor.

The heated curler brush of this invention comprises a rod housing which serves as a handle, a plastic outer tube supporting curler brush and an aluminum inner tube. The inner tube is made of rigid aluminum and is fixedly connected to said handle and protrudes therefrom, a heater, preferably a positive temperature coefficient heater, is inside said inner tube positioned so that maximum uniform heating of the outer tube and brush occurs. This position is such that the axial center of the heater is forward of the longitudinal center of the inner tube at a point which offsets the unequal heat loss rate to the atmosphere of the forward and rearward ends of the outer tube. The heater is connected by electrical contacts to a swivel cord in the handle. The inner tube can be all aluminum or the aluminum portion can extend from the connection in the handle to the front end or can be only the portion protruding from the handle. The outer tube with a round brush thereon is rotatably supported on the inner tube and is in heat conduction relationship therewith. The inner tube is fixed to the handle by a through bolt near its rearmost end. The outer tube is held in the handle by a circular guide in the front end of the handle which mates with a notched flange at the rear of the outer tube. The flange has notches which in conjunction with a spring latch device, attached pivotally to the inner tube, holds the round brush fast or releases it to freely rotate. The outer tube is supported by the inner tube and held captive by an inward facing grove on the front edge of the handle which mates with the notches flange. The front end of the outer tube is supported by the front end of the inner tube. The inner tube extends substantially the whole length of the outer tube.

DESCRIPTION OF THE PREFERRED EMBODIMENT

Figure 1:
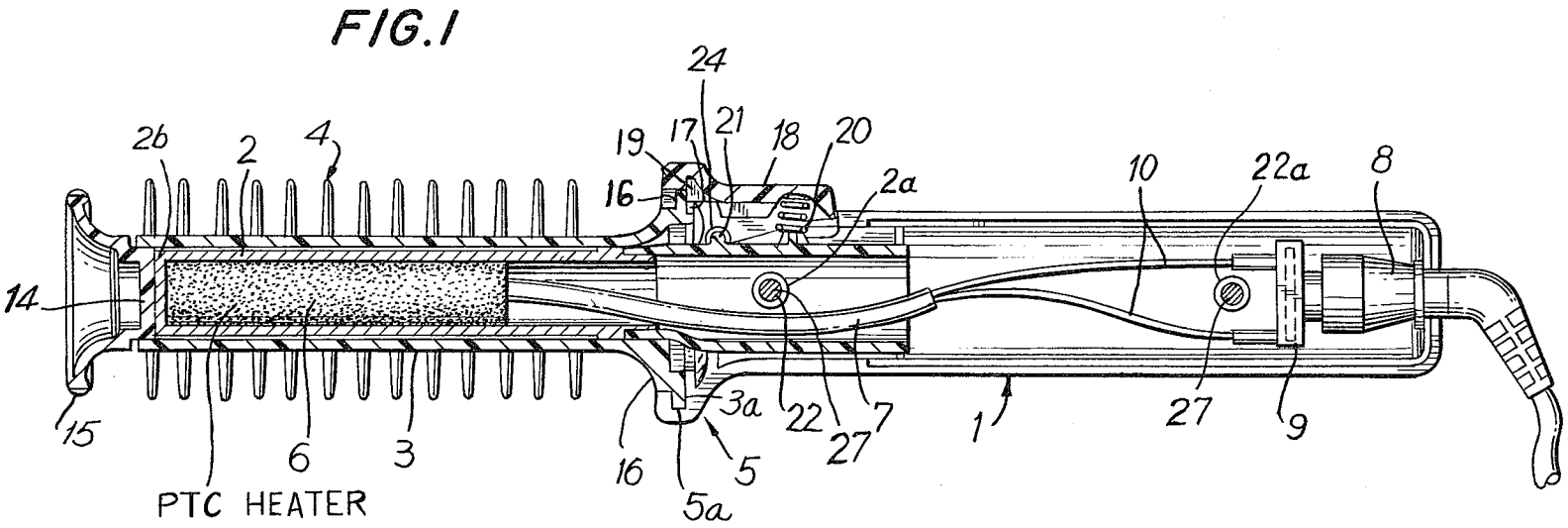
FIG. 1 is an axial section of the heated curling brush of this invention.
Figure 2:
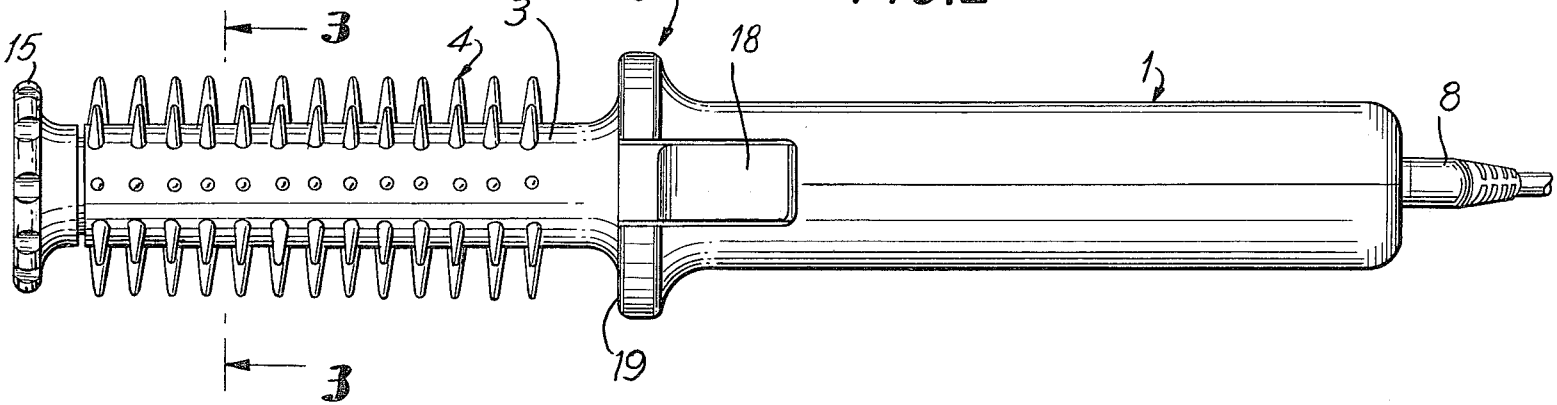
FIG. 2 is a top elevational view of the curling brush of FIG. 1.

Referring to the drawings, the heated hair curler as shown in FIG. 1 comprises a rod housing 1 which serves as a handle, and inner tube 2 made of aluminum protruding from the rod housing 1. The inner tube 2 can be all aluminum or can be aluminum from at least the portion protruding from the rod housing 1. The inner tube 2 can be made by deep drawing, extrusion or other means. The inner tube 2 is attached fixedly to the rod housing 1 by means of a post 22 on the inner surface of the housing 1 through a hole 2*a* in the inner tube 2.

The halves of the housing 1 are secured together by screws 27 which are inserted into a post 22 in the front portion of the housing 1 and a post 22*a* in the rear portion of the housing 1.

The inner tube 2 serves to rotatably support an outer tube 3 and to conduct heat from the heater 6 to the outer tube 3. The coupling 5, shown in more detail in FIG. 4, between the handle 1 and the outer tube 3, holds the round brush 4 supported by the outer tube 3 by a circular guide 5*a* in the front of the handle 1 which mates with a notched flange 3*a* at the rear of the outer tube 3. The electric heating device 6 is a PTC thermistor such that its axial center is located forward of the longitudinal center of the inner tube 2 at a point which offsets the unequal heat loss rate of the atmosphere of the forward and rearward ends of the outer tube. The heating device 6 is connected to a power source, not shown, by electric cord 7 which is introduced into the handle (rod housing) 1 and connected at commutating devide 9 by wires 10 extending from the PTC thermistor 6 into the handle 1 to a swivel coupling 8.

The outer tube 3 and round brush 4 consist of a heat conductive material which has a coefficient of heat expansion compatible with the aluminum of the inner tube 2, for example, polyamide containing a fiberglass filling.

Figures 3, 4:
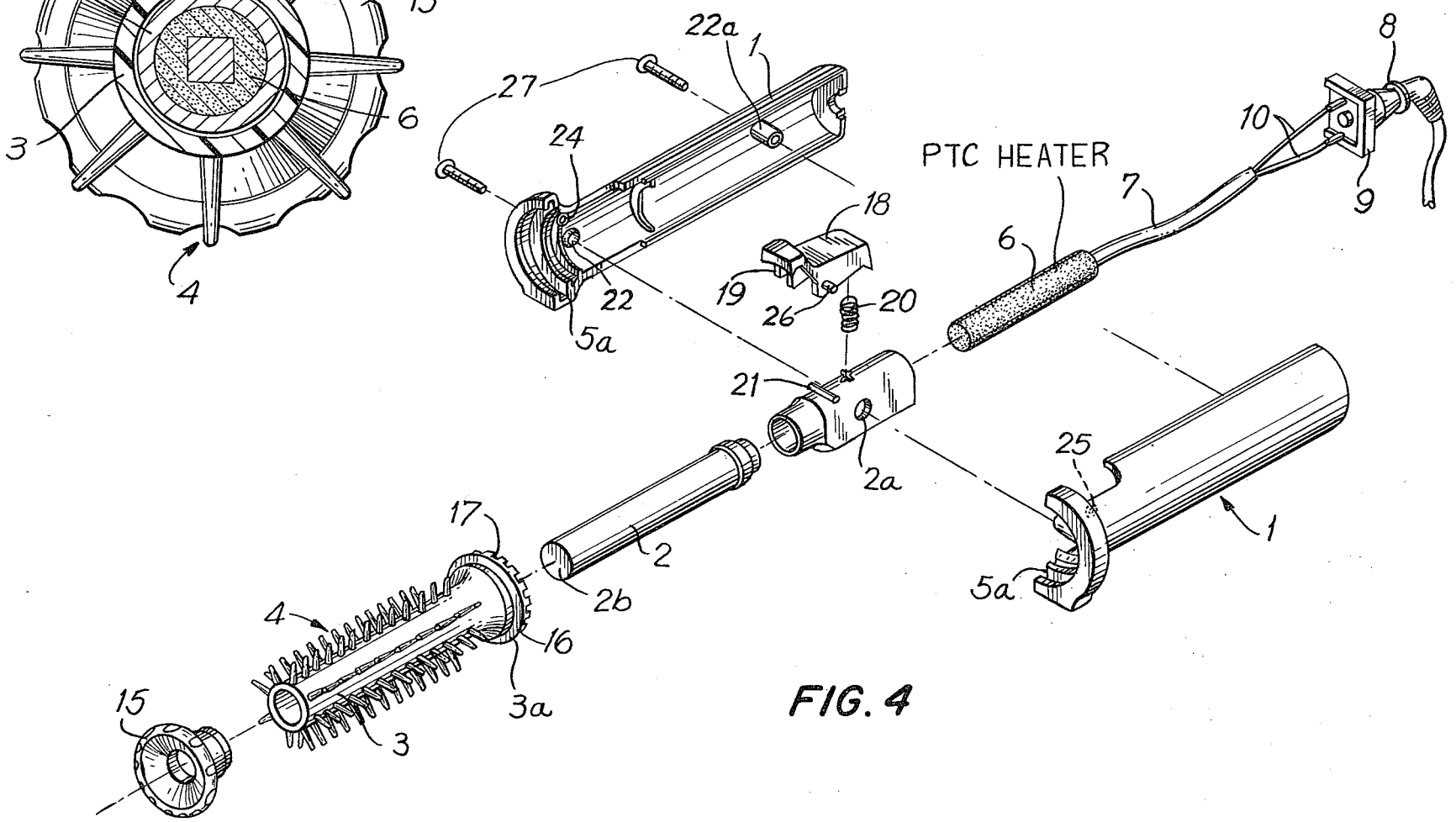
FIG. 3 is a sectional view taken along line 3—3 of FIG. 2.
FIG. 4 is an exploded view in perspective of the curling brush of FIG. 1.

The inner tube 2 has a blind front end **2*b* which provides an axial forward stop for the heater 6. This blind front 2*b* on the inner tube 2 abuts the blind front end 14 of the outer tube 3 at a position farther forward than in prior devices so that the inner tube 2 is substantially in the whole length of outer tube 3. The outer diameter of the inner tube 2 is close fitting within the inner diameter of the outer tube 3 to maintain maximum heat transfer. These diameters may be very close fitting and still permit free rotation of the outer tube 3 in view of the compatable coefficients of thermal expansion of the plastic outer tube 3 and aluminum inner tube 2. The outer tube 3 has an unheated grip 15 on its front end. The rear end of the outer tube 3 is a flange 16 as shown in FIG. 4 with latching notches 17 into which a coupling key 18 with a coupling nose 19 can be engaged. The coupling key 18 is pivotably supported on the inner tube 2 between the outer tube 3 and rod housing 1 at pivot axis 21. The coupling key 18 is supported against the inner tube 2 with a compression spring 20. In this way, the coupling nose 19 is automatically swung into coupling position to hold the outer tube 3 fast until the operator actuates the coupling key 18 for disengagement, then the outer tube 3 and round brush 4 rotate freely. The inner tube 2 preferably has a pivot axis 21 thereon for the coupling key 18 which fits into depressions (not shown) on each side of the inside of the coupling key 18 opposite a pivot axis 26. The coupling key 18 is also pivotally supported on the rod housing 1 by depression 24 and 25 therein which engage the pivot axis 26, shown in FIG. 4**.

The heated lockable rotatable curling brush, in use, operates as follows. The operator releases the outer tube 3 and round curler brush 4 by pushing the coupling key 18 and winds the hair around the curler brush 4 while rotating outer tube 3 and the curler brush 4. When the hair is wound up to the desired degree, the coupling key 18 is released, locking the rotating brush 4, and the electric plug, not shown, is plugged into an electric power source which heats the PTC heater 6 causing the aluminum inner tube 2 to become heated by conduction and the outer tube 3 and round brush 4 thereon to also become heated by conduction. When the hair is curled as desired, the coupling key 18 is pushed releasing the outer tube 3 and round brush 4 to rotate freely. The curler brush is then pulled outward from the head, releasing the hair.

In order to demonstrate the effect of the aluminum inner tube 2 and the placement of the PTC heater 6 on the uniformity of temperature on the rotating curler brush 4, the following tests were conducted.

In each case the curling brush was heated until the temperature stabilized. The first series was run on the known curling brush manufactured by WIK Electro-Hausgerate Vertriebs GmbH & Co. of West Germany under the name Rollomatic-Brush in which the inner tube is the same material as the outer tube. Using 120 volts, the temperature was measured as shown in the following tables.

TABLE 1

Input 120V, Ambient Temperature 23° C.

| | Outer Tube Temps | | |
|---|---|---|---|
| Time On | 1¼" from center towards tip-TC #1 | Center TC #2 | 1¼" from center towards handle-TC #3 |
| 1 min. | 23° C. | 38° C. | 30° C. |
| 2 min. | 24° C. | 61° C. | 47° C. |
| 3 min. | 26° C. | 78° C. | 62° C. |
| 4 min. | 29° C. | 89° C. | 72° C. |
| 5 min. | 31° C. | 93° C. | 80° C. |
| 10 min. | 42° C. | 113° C. | 97° C. |
| stabilized temp. | 47° C. | 118° C. | 102° C. |

TABLE 2

| | Outer Tube Temps | | |
|---|---|---|---|
| Time On | 1¼" from center towards tip-TC #1 | Center TC #2 | 1¼" from center towards handle-TC #3 |
| 1 min. | 23° C. | 42° C. | 28° C. |
| 2 min. | 24° C. | 70° C. | 45° C. |
| 3 min. | 28° C. | 87° C. | 60° C. |
| 4 min. | 31° C. | 98° C. | 72° C. |
| 5 min. | 36° C. | 106° C. | 77° C. |
| 10 min. | 47° C. | 120° C. | 96° C. |
| stabilized temp. | 53° C. | 126° C. | 101° C. |

The data in Tables 1 and 2 demonstrate that the use of the plastic inner tube and the location of the heater results in very uneven heat distribution in the outer tube and brush.

TABLE 3

Plastic inner tube was replaced with an aluminum tube located same as plastic.
Amb. Temp. 23° C., input 120V
TC #1-1¼" from outer tube center towards tip
TC #2-outer tube center
TC #3-1¼" from outer tube center towards handle

| | Outer Tube Temps °C. | | |
|---|---|---|---|
| Time On | TC #1 | TC #2 | TC #3 |
| 1 min. | 25° C. | 48° C. | 36° C. |
| 90 sec. | 26° C. | 62° C. | 47° C. |
| 2 min. | 28° C. | 76° C. | 57° C. |
| 3 min. | 31° C. | 93° C. | 74° C. |
| 4 min. | 35° C. | 104° C. | 86° C. |
| 5 min. | 39° C. | 113° C. | 95° C. |
| 6 min. | 42° C. | 118° C. | 101° C. |
| 7 min. | 44° C. | 122° C. | 106° C. |
| 8 min. | 46° C. | 125° C. | 109° C. |
| 9 min. | 48° C. | 127° C. | 113° C. |
| 10 min. | 49° C. | 128° C. | 114° C. |
| 15 min. | 51° C. | 130° C. | 115° C. |

This test indicated that the aluminum raises the outer surface temperature through better beat conduction, but showed that heat is being lost at the front end of the outer tube due to exposure of larger surface areas to the ambient atmosphere.

TABLE 4

The outer tube was bored out to allow the aluminum tube and heater used in Table 3 to be pushed ⅝" further into the outer tube (⅝" beyond original position).
Result:
Amb. Temp. 23° C., input 120V
TC #1-1¼" from outer tube center towards tip
TC #2-barrel center
TC #3-1¼" from outer tube center towards handle

| | Outer Tube Temps °C. | | |
|---|---|---|---|
| Time On | TC #1 | TC #2 | TC #3 |
| 1 min. | 47° C. | 40° C. | 28° C. |
| 90 sec. | 63° C. | 55° C. | 35° C. |
| 2 min. | 76° C. | 67° C. | 43° C. |
| 3 min. | 92° C. | 86° C. | 58° C. |
| 4 min. | 104° C. | 98° C. | 70° C. |
| 5 min. | 110° C. | 106° C. | 78° C. |
| 6 min. | 116° C. | 113° C. | 84° C. |
| 7 min. | 119° C. | 116° C. | 88° C. |
| 8 min. | 121° C. | 118° C. | 90° C. |
| 9 min. | 123° C. | 122° C. | 93° C. |
| 10 min. | 123° C. | 122° C. | 94° C. |
| 15 min. | 127° C. | 126° C. | 99° C. |

This test indicated that the aluminum tube and heater had been moved too far forward since the outer tube was cooler in the portion on the handle end of the center.

TABLE 5

Using the same bored out outer tube as in Table 4, the aluminum tube and heater were pushed 7/16" further into the outer tube (7/16" beyond the original position but 3/16" less than in the test shown in Table 4).
Amb. Temp. 23° C., input 120V
TC #1-1¼" from outer tube center towards tip
TC #2-outer tube center
TC #3-1¼" from outer tube center towards handle

| | Outer Tube Temps °C. | | |
|---|---|---|---|
| Time On | TC #1 | TC #2 | TC #3 |
| 1 min. | 43° C. | 42° C. | 35° C. |
| 90 sec. | 58° C. | 57° C. | 49° C. |
| 2 min. | 71° C. | 69° C. | 60° C. |
| 3 min. | 88° C. | 88° C. | 78° C. |
| 4 min. | 97° C. | 98° C. | 90° C. |
| 5 min. | 105° C. | 107° C. | 98° C. |
| 6 min. | 109° C. | 112° C. | 104° C. |
| 7 min. | 114° C. | 117° C. | 109° C. |
| 8 min. | 118° C. | 121° C. | 112° C. |
| 9 min. | 118° C. | 121° C. | 114° C. |
| 10 min. | 119° C. | 122° C. | 115° C. |
| 15 min. | 121° C. | 125° C. | 119° C. |

The data in Tables 3, 4 and 5 demonstrate that the use of an aluminum inner tube results in improved heat distribution in the outer tube and brush and that when the inner tube and heater are moved further than previously but not too far into the outer tube even heat distribution and optimum results are obtained.

The following test were run using the WIK curling brush with different thicknesses of aluminum wrapped around the plastic inner tube but within the plastic outer tube. The results are shown after the tempratures stabilized.

TABLE 6

| Tip End Degrees C. | Center Degrees C. | Handle End Degrees C. |
|---|---|---|
| A. 0.1 MM thick Aluminum Sleeve | | |
| 48 | 118 | 92 |
| B. 0.2 MM Thick Aluminum Sleeve | | |
| 55 | 120 | 101 |
| 77 | 125 | 104 |
| C. 0.5 MM Thick Aluminum Sleeve | | |
| 68 | 116 | 107 |
| D. 1.0 MM Thick Aluminum Sleeve | | |
| 96 | 125 | 111 |

After altering the outer tube to minimize the amount of heat drawn away from the surface, the following results were obtained using 0.2 mm aluminum.

| Tip End | Center | Handle |
|---|---|---|
| 100° C. | 127° C. | 111° C. |

The data in Table 6 demonstrates that the use of aluminum wrapped around the plastic inner tube is superior to the plastic inner tube alone but is not as advantageous as the aluminum inner tube in which the heater and aluminum inner tube are positioned forward as compared to the prior art device.

What is claimed is:

1. A heated lockable rotatable curling brush for styling and curling hair comprising:

a rod housing serving as a handle;

an elongated cylindrical inner tube made substantially of aluminum fixedly attached to said rod housing, protruding therefrom; and adapted to rotatably support an outer tube;

an outer tube of heat conducting plastic supporting a round brush, rotatably supported on said inner tube and in heat conductive contact therewith, wherein said inner tube is in heat conducting contact with substantially the whole length of said outer tube;

an elongated resistance heater in said inner tube in heat conduction relationship therewith, and with the axial center of the heater positioned forward of the longitudinal center of said inner tube at a point which offsets the unequal heat loss rate to the atmosphere of the forward and rearward ends of the outer tube to thereby provide substantially uniform heating of the outer tube and brush; an electric cord in the inner tube connected to the heater and an outside power source; and a selectively engageable spring latch coupling mechanism between the handle and outer tube at the front of the rod housing for locking the outer tube and rotatably releasing the outer tube.

2. The curling brush of claim 1 wherein said heater is a positive temperature coefficient thermistor.

* * * * *